US005535674A

United States Patent [19]

Vrotacoe et al.

[11] Patent Number: 5,535,674

[45] Date of Patent: Jul. 16, 1996

[54] DISTORTION-REDUCED LITHOGRAPHIC PRINTING PRESS

[75] Inventors: James B. Vrotacoe, Rochester; Charles D. Lyman, Farmington; Edward E. Urquhart, Portsmouth, all of N.H.

[73] Assignees: Heidelberger Druckmaschinen AG, Heidelberg, Germany; Heidelberg Harns, Inc., Dover, N.H.

[21] Appl. No.: 265,178

[22] Filed: Jun. 24, 1994

[51] Int. Cl.[6] ..... B41F 13/22; B41F 27/00

[52] U.S. Cl. ..... 101/216; 101/217; 101/375; 101/487; 492/46

[58] Field of Search ..... 101/141, 142, 101/148, 216, 217, 219, 348, 375, 376, 487, 488; 492/4, 46; 165/89

[56] References Cited

U.S. PATENT DOCUMENTS

| | | | |
|---|---|---|---|
| 2,849,951 | 9/1958 | Heinrich | 101/487 |
| 3,146,709 | 9/1964 | Bass et al. | 101/375 |
| 3,771,591 | 11/1973 | Larsen | 165/89 |
| 4,089,265 | 5/1978 | White et al. | 101/375 |
| 4,093,023 | 6/1978 | Frantsenjuk | 165/89 |
| 4,144,813 | 3/1979 | Julian | 101/375 |
| 4,534,289 | 8/1985 | Dürrnagel et al. | 101/348 |
| 4,685,393 | 8/1987 | Sauerissig | 101/375 |
| 4,794,858 | 1/1989 | Katz | 492/4 |
| 4,913,048 | 4/1990 | Tittgemeyer | 101/216 |
| 5,074,213 | 12/1991 | Kurosawa | 101/216 |
| 5,174,206 | 12/1992 | Molinatto | 101/216 |

FOREIGN PATENT DOCUMENTS

| | | | |
|---|---|---|---|
| 386316 | 9/1990 | European Pat. Off. | 101/487 |
| 0421145B1 | 4/1991 | European Pat. Off. . | |
| 2431371 | 3/1980 | France | 101/375 |
| 21453 | 1/1991 | Japan | 101/487 |

*Primary Examiner*—Stephen Funk
*Attorney, Agent, or Firm*—Kenyon & Kenyon

[57] ABSTRACT

In a lithographic printing press for printing on material in sheet or web form, a plate cylinder has a printing form mounted thereon. A gapless blanket cylinder is engageable with the plate cylinder and a tubular, removable blanket having a continuous surface is mounted on the blanket cylinder. Mechanisms to expand a cylindrical sleeve are provided as well as mechanisms to reduce cylinder distortion during rotation.

17 Claims, 7 Drawing Sheets

DISTORTION-REDUCED LITHOGRAPHIC PRINTING PRESS

FIELD OF THE INVENTION

The present invention concerns a lithographic printing press for printing on material in sheet or web form.

BACKGROUND OF THE INVENTION

French patent application FR 2,431,371 discloses a printing unit cylinder with an axially extending groove to allow for the mounting of printing plates or conventional blankets on its circumference. Because of the groove, the printing unit cylinder is imbalanced during its rotation around its axially extending central axis. The consequences of the imbalanced state of the printing unit cylinder are sought to be cured by a liquid filling an inner chamber of the printing unit cylinder.

The solution of FR 2,431,371 does not allow for an additional gas chamber to change a cylinder blanket or plate on the circumference of the printing unit cylinder. Furthermore, an evenly distributed temperature profile cannot be achieved, since the circumference of the cylinder is interrupted by an axially extending groove where plate or blanket edge clamping elements are located. Since there is a gap extending on the circumference of this cylinder, the heat generation is not evenly distributed. An uneven heat input will cause an uneven temperature distribution.

European patent specification EP 0 421 145 B1 discloses a printing machine for printing on material in sheet or web form. A gapless, tubular sleeve can be removed by radially expanding the tubular sleeve. Gas chambers are provided for the sole purpose of allowing pressurized gas to blow off the tubular gapless sleeve from the circumference of the respective printing unit cylinder. No mechanism is provided to reduce an unevenly distributed temperature profile around the print unit cylinders in the circumferential direction.

U.S. Pat. No. 4,183,298 discloses a water cooled ink roller for printing presses. Within the hollow roller body there is provided a cylindrical partition having a conical shape. Due to the conical shape of the cylindrical partition and the uneven mass distribution within the ink roller, a non-uniform heat distribution may occur.

U.S. Pat. No. 4,534,289 discloses a cooling roller with different preselected cooling zones. To keep the ink temperature largely constant during operating interruptions a displacement body is disposed in the interior of the ink roller.

On printing unit cylinders having a small cylinder diameter to cylinder length ratio, an uneven temperature distribution on the printing unit cylinders circumference may effect a bending of the cylinder. Uneven temperature distribution on the printing unit cylinders circumference can be further amplified by high nip passing frequencies encountered at high press speeds. The smaller the cylinder diameter compared to its axial length, the more the printing unit cylinder tends to bend perpendicular to its axial extension. The absolute temperature level, furthermore, is of less importance than an even temperature profile around the printing unit cylinder circumference.

SUMMARY OF THE INVENTION

An object of the present invention is to provide a printing unit cylinder allowing for efficiently distributing a non-uniform heat input, thereby minimizing any temperature differential.

It is a further object of the present invention to allow for easing out distortions due to a differential temperature in a circumferential direction of a printing unit cylinder.

Furthermore it is an object of the present invention to provide a printing unit cylinder having sleeve expanding means and distortion reducing means being sealed from each other.

It is another object of the present invention to allow for a printing unit cylinder capable of easing out temperature differences during rotation automatically as they occur.

The present invention contemplates a printing unit cylinder for use in a lithographic printing press, capable of supporting a removable sleeve-shaped element and having reduced susceptibility to thermal distortion. The printing unit cylinder includes a cylinder body having an exterior or outer surface and a major or center axis. The cylinder body contains at least one air passage extending generally parallel to the center axis, at least one gas inlet disposed in the cylinder body and connecting the air passage with the outer surface of the cylinder body. The cylinder body further includes an inner compartment isolated, such as by an hermetic seal, from the gas passage and adapted to contain a fluid. The fluid serves to maintain a substantially uniform and constant temperature level around the circumference of the cylinder. A penetration is disposed in the cylinder body to connect the inner compartment with the outer surface of the cylinder body to permit the inner compartment to be charged with a fluid. The cylinder body further includes a blow off aperture disposed in its outer surface and in fluid communication with the gas passage. The blow off aperture serves to conduct gas to the outer surface of the cylinder body in order to facilitate the installation and removal of the sleeve-shaped element.

The printing unit cylinder may further comprise a seal disposed within the cylinder body and between the air passage and the inner compartment for hermetically isolating the air passage from the inner compartment.

The solution according to the present invention allows for maintaining a uniform temperature level around the circumference of a printing unit cylinder. One embodiment provides one axially extending gas passage being connected to grooves for blowing off the tubular sleeve. The air passage passes at least one compartment within the printing unit cylinder being filled with a fluid. The fluid contained within the printing unit cylinder body can either be a sealed fluid or a circulating fluid. A fluid content filling 90–95% of the printing unit cylinder body is also conceivable. The gas passage guiding the gas to blow off the tubular sleeve is sealed from the fluid-containing compartments.

A further embodiment of the present invention provides two gas passages extending parallel to the cylinder central axis. Both gas passages are sealed hermetically from the at least one fluid containing compartment by means of a ring being affixed to one side of the printing unit cylinder and by means of two plugs closing the air passages on the opposite unit cylinder. In this embodiment of the present invention the gas passages for blowing off a tubular sleeve are sealed hermetically from the liquid containing departments.

It should be clear that the present invention could be used in a variety of lithographic printing presses, including use as either the printing cylinder or transfer cylinder in an offset printing press or for both. An example of an offset press which has a tubular blanket for the transfer cylinder is described in U.S. Pat. No. 5,241,905 to Guaraldi et al., which is hereby incorporated by reference.

BRIEF DESCRIPTION OF THE DRAWINGS

The present invention will be best understood when read with the accompanying drawings herein.

DETAILED DESCRIPTION

Figure 1:
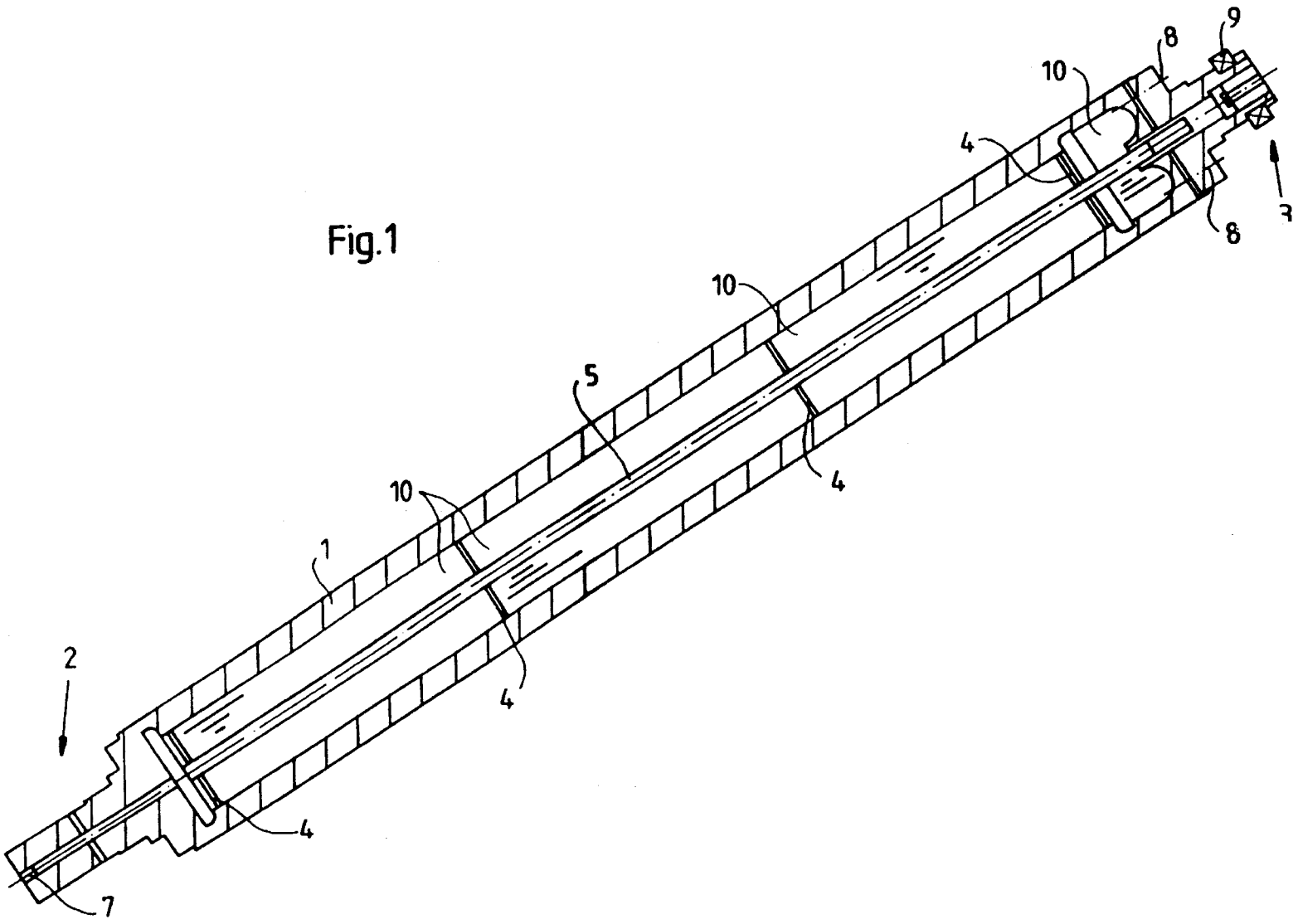
FIG. 1 is a schematic view of a printing unit cylinder with a vertically extending gas passage.

FIG. 1 shows a schematic view of a printing unit cylinder according to the present invention.

A cylinder body 1 having a small cylinder diameter to cylinder length ratio has a gear side 2 and an operator side 3. There is a gas passage 5 extending along the center axis of the cylinder body 1. The gas passage 5 is fed from one gas inlet 7 placed on the gear side 2 of the cylinder body 1. The cylinder body 1 comprises at least one inner compartment 10 which is to be filled with fluid from one or more insertion openings 8 on the operator side 3 of the cylinder body 1. The compartment 10 is equipped with baffles 4 holding the gas passage 5 and allows for the fluid to pass through the cylinder. The volume of the fluid contents can fill up to 90–95% of the inner compartment 10 of the cylinder body 1. The compartment 10 is filled either with a closed content of fluid or with a pressurized fluid. However, it is conceivable to provide a circulating fluid within the at least one compartment 10. In addition, a liquid/gas mixture can also be filled in the cylinder compartment 10. Also, it is conceivable to fill fluids into two or more separate passages of the cylinder.

Figure 2:
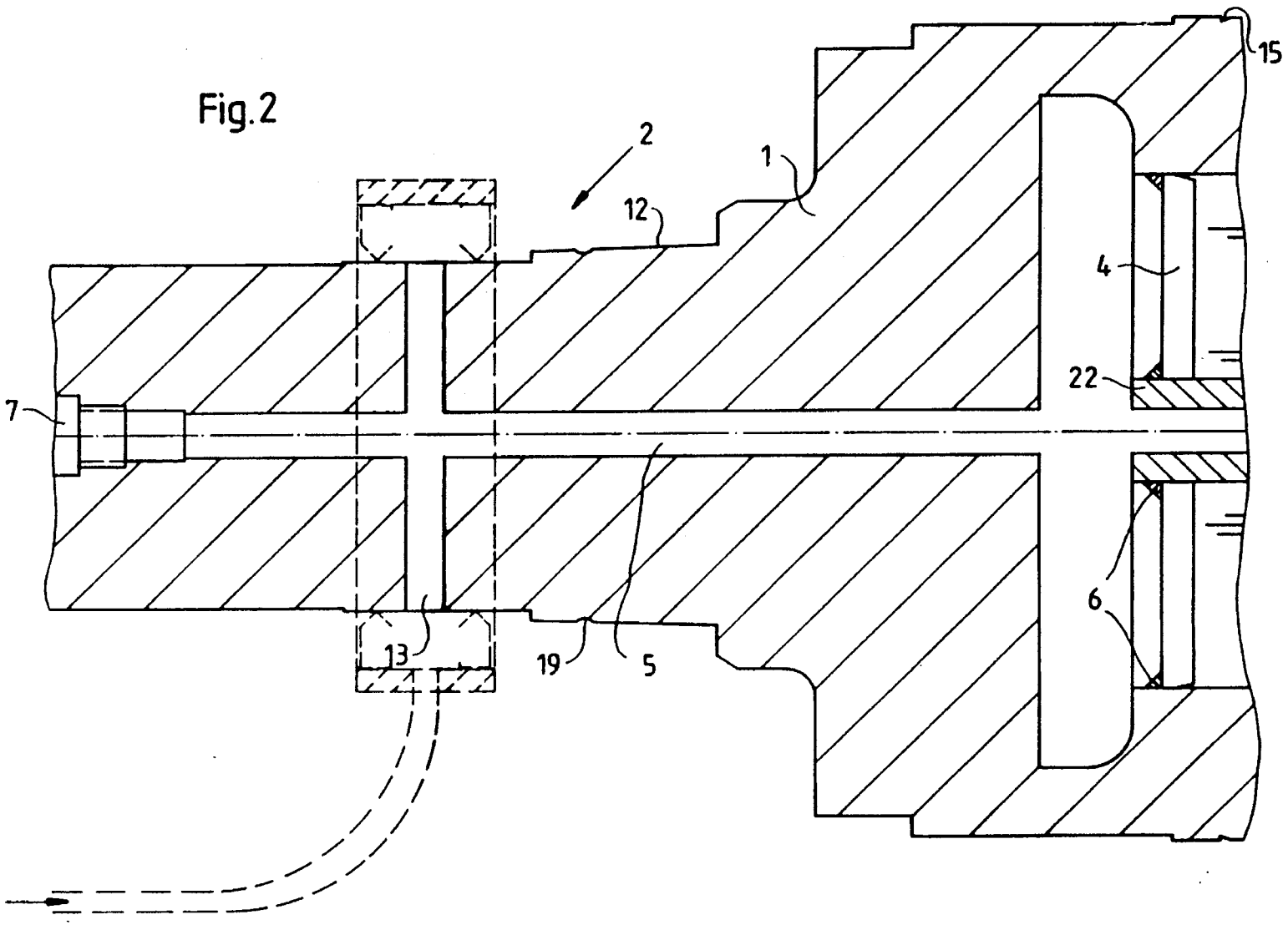
FIG. 2 is an enlarged view of the gear side of the printing unit cylinders.

FIG. 2 shows an enlarged view of a printing unit cylinder's gear side end 2.

The gas inlet 7 is connected via gas passage 5 to a cylindrical gas tube 22 being fastened on baffles 4 inside the inner at least one compartment 10. The baffles 4 are connected via weldings 6 to the gas tube 22 on one side and to the cylinder body 1 on the other side. The gas passage 5 and the cylindrical gas tube 22 are mounted coaxially to the central axis of the printing unit cylinder's body 1. Reference numeral 12 identifies a bearing portion on which a cylinder bearing 9 is mounted (See FIG. 3). The bearing portion 12 comprises a bearing groove 19 oriented in a circumferential direction to allow for replacing a bearing. According to the dashed lines in FIG. 2, gas pressure can be applied through a bore 13 to the printing unit cylinder for blanket removal if the printing unit cylinder is a blanket cylinder or for plate removal if the printing unit cylinder is a plate cylinder. Reference numeral 15 identifies a groove allowing the pressurized gas to blow off a cylindrical tubular sleeve (or cylindrical printing plate) from the surface of the cylinder body 1 (See also FIG. 3). It is understood that the printing unit cylinder body 1 may have several grooves 15 mutually spaced from one another on its circumference in order to support a gas cushion which facilitates the axial removal of a tubular sleeve.

Figure 3:
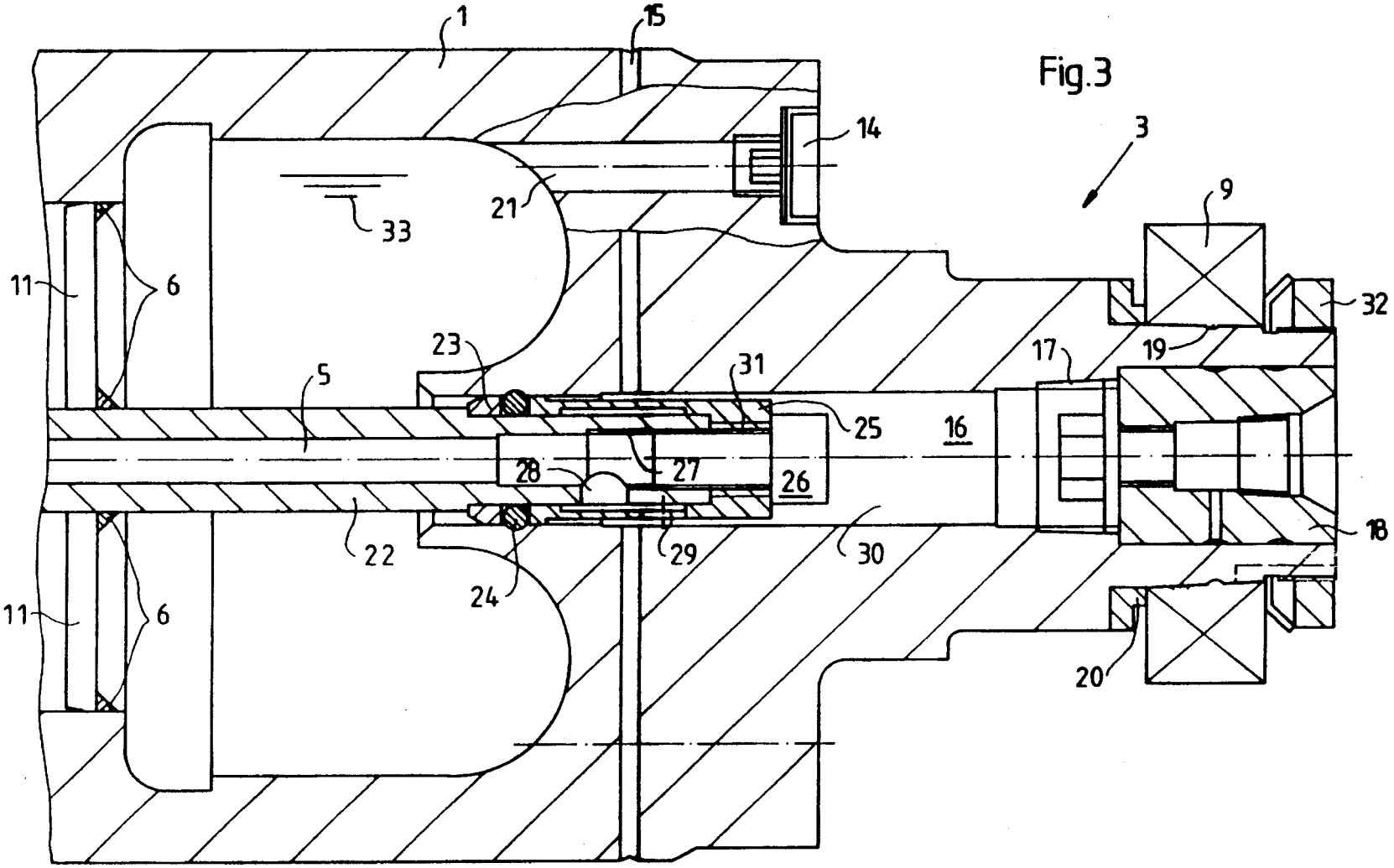
FIG. 3 is an enlarged view of the operator side of the printing unit cylinder, FIGS. 4(*a–c*) are enlarged views of the operator side of alternative embodiments of a printing unit cylinder

FIG. 3 is an enlarged view of a printing unit cylinder's operator side.

The gas passage 5 on the operator side 3 of the printing unit cylinder body 1 is fastened by means of welding 6 on baffles 11. The printing unit cylinder body 1 has a compartment 10 filled with a fluid 33; the inlets 21 allow for filling of compartment 10 and are closed by means of plugs 14. The gas tube 22 extends through the fluid 33 into a central bore 16 on the operator side 3 of the printing unit cylinder body 1. The central bore 16 is sealed from the liquid content 33 by means of a compressible seal 24. The compressible seal 24 is positioned between a ring 23 and a compression sleeve 25. The compression sleeve 25 can move in an axial direction on the gas tube 22 and has an opening 29 on its circumference. The compression sleeve 25 is compressed by a compression bolt 26 which is provided in the threading 27 of the gas tube 22. Furthermore, the gas tube 22 is provided with an escaping bore 28.

When the gas passage 5 is charged with a means to expand a tubular sleeve—i.e. pressurized air—the gas volume will pressurize the gas tube 22. Then the gas will enter gas chamber 30 via escaping bore 28 and opening 29. The blow off groove 15 on the printing unit cylinder body 1 is connected to the gas chamber 30.

The gas chamber 30 on the other hand is sealed from the atmosphere by a hardened center piece 18 which is provided in a threading 17 of the printing unit cylinder body 1. When replacing the seal 24, center piece 18 is removed from the central bore 16. The compression bolt 26 is then taken from the end of the gas passage 22. The compression sleeve 25 may then be removed by a tool which engages the removal thread 31 of the compression sleeve 25. Replacement of seal 24 is then possible.

On the operator side 3 of the cylinder body 1 the bearing 9 is fixed in its position by means of a lock nut 32. The bearing 9 is placed on a conical shaft provided with a groove extending in a circumferential direction. The bearing 9 in its fixed position abuts a ring 20 defining the fixture of the bearing 9 on its conical seat.

Figure 4A:
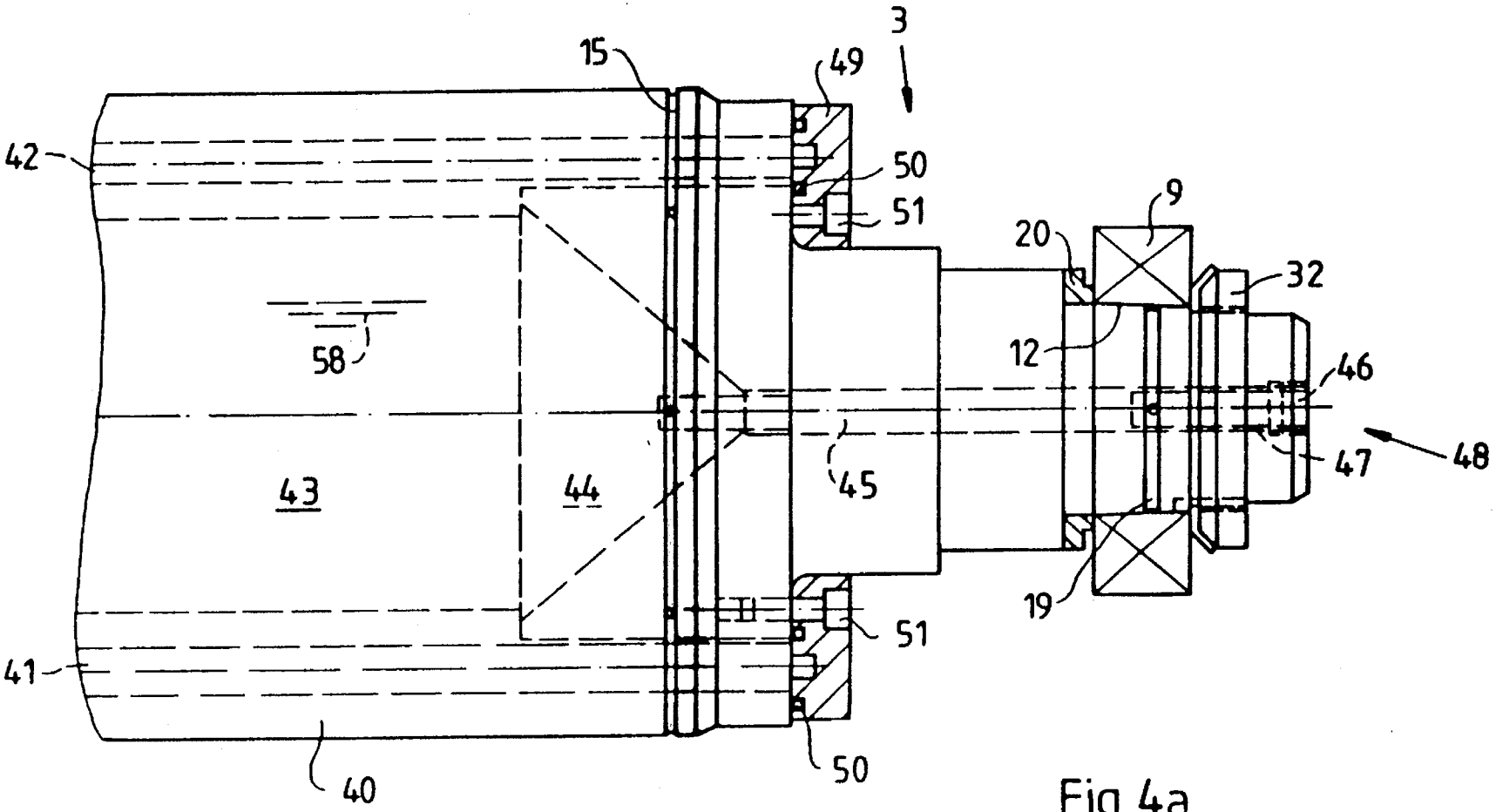
Figure 4B:
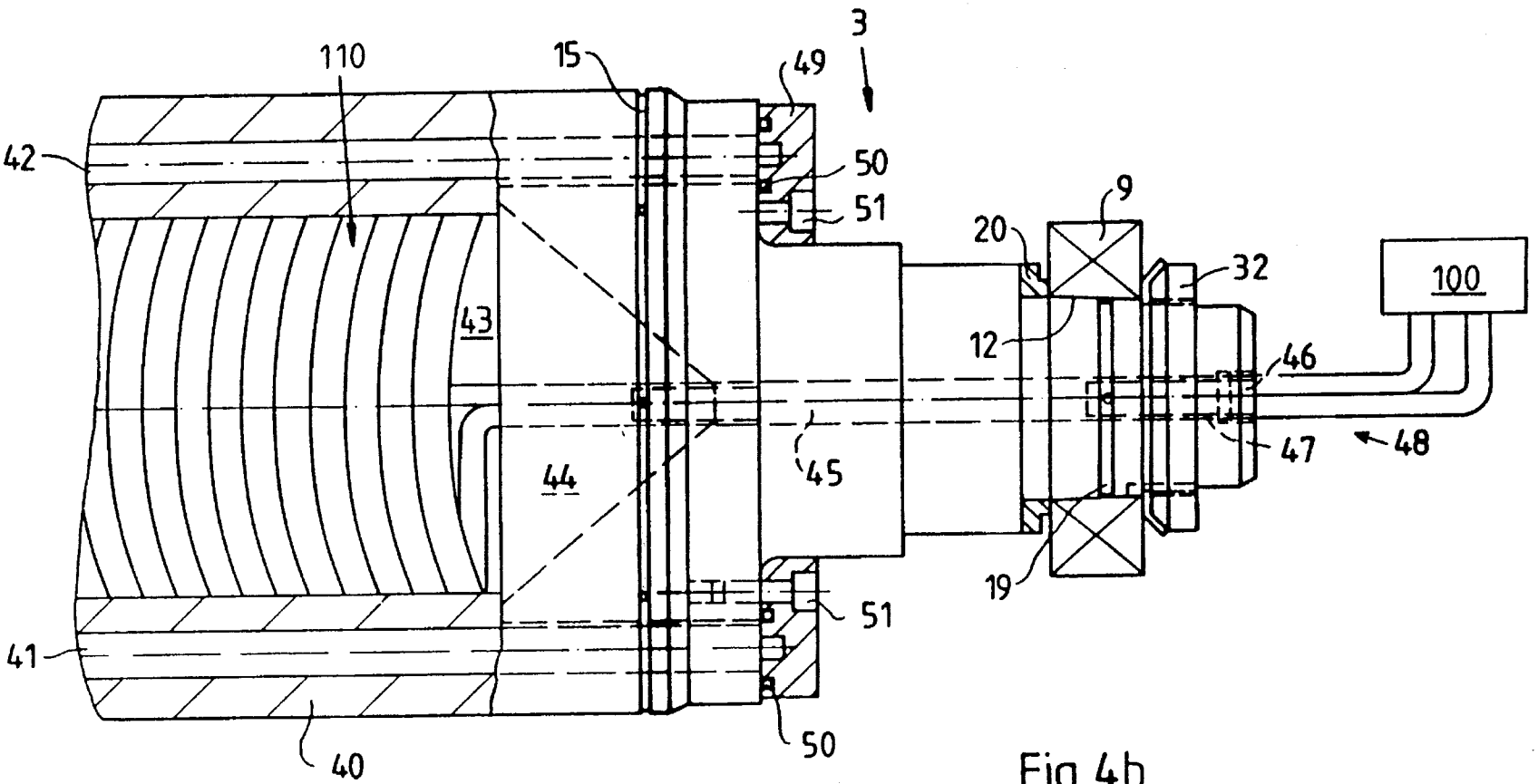
Figure 4C:
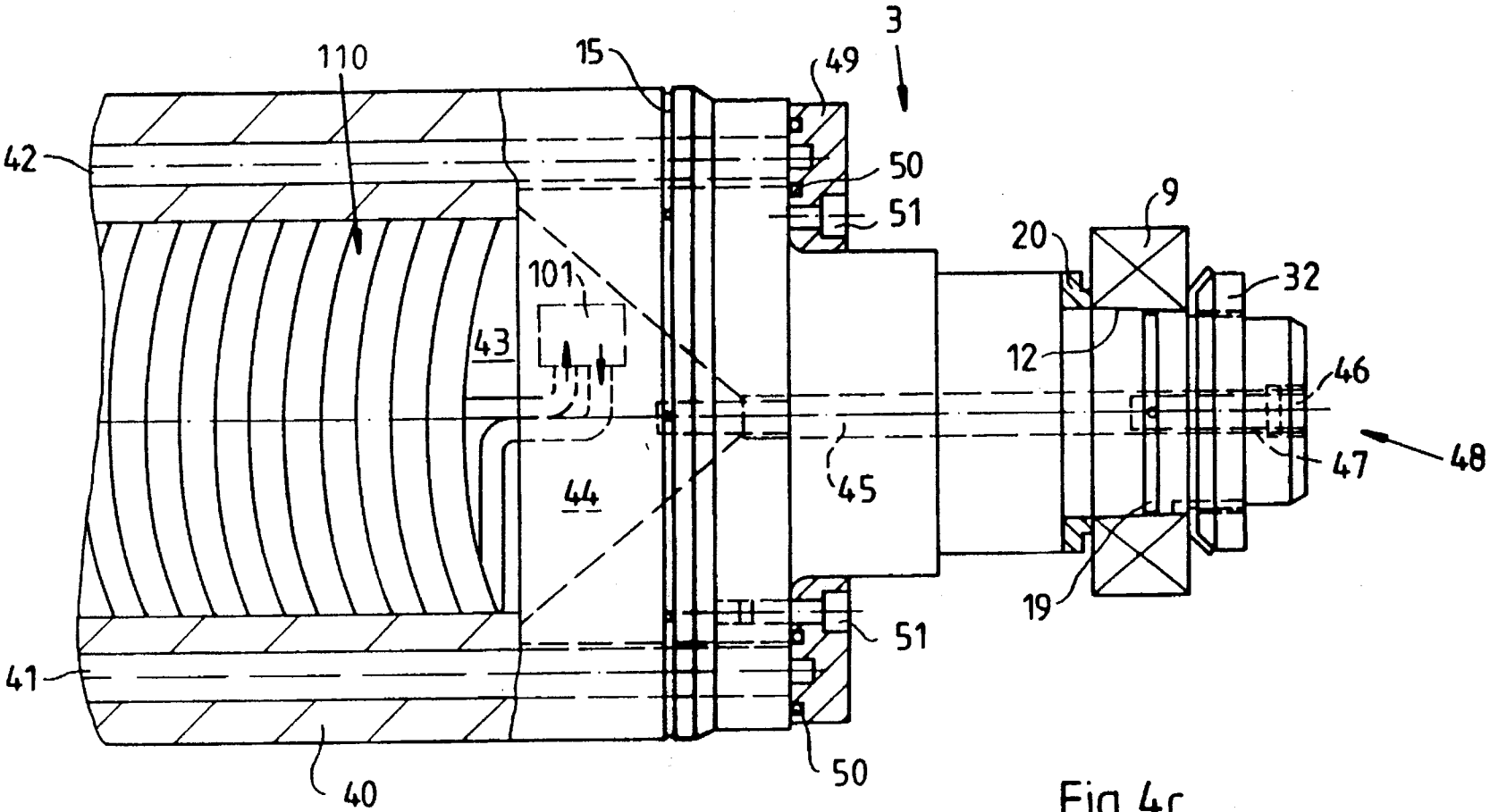

FIGS. 4(*a*) shows the operator side of a printing unit cylinder body according to an alternative embodiment of the present invention.

In a further embodiment of the present invention a printing unit cylinder body 40 is provided with at least one compartment 43, symmetrically arranged with respect to the center axis of the cylinder body 40. The compartment 43 contains a fluid 58 and has a conical region 44 connected to a central bore 45 extending from an insertion opening 48 located on the operator side 3. The insertion opening 48 is closed by means of a locking bolt 46 engaged in threading 47. The at least one compartment 43 is filled through the central bore 45 with a volume of a fluid. The volume of the fluid can fill up to 90–95% of the compartment 43. The fluid either is unpressurized when filled or, alternatively, may be pressurized. It is also conceivable to make use of a circulating fluid not only to provide a means to reduce cylinder distortion due to uneven thermal heat-input but to furthermore lower the temperature level of the printing unit cylinder body 40. As can be seen in FIG. 4, the fluid 58 is completely separated from a first gas passage 41 and a second gas passage 42.

On the operator side 3 of the cylinder body 40 a bearing 9 is mounted on a conical portion of the cylinder shaft fixed by means of a lock nut 32. On the conical portion of the cylinder shaft, a groove 19 extending in a circumferential direction is provided.

In the printing unit cylinder body 40, two gas passages 41, 42 are provided. They extend parallel to the central axis of the printing unit cylinder body 40. The gas passages 41, 42 are sealed by a ring 49 which is affixed to the printing unit cylinder body 40 by fixing screws 51. The ring 49 is equipped with two seals 50 which seal the gas passages 41, 42 from the surrounding atmosphere.

Figure 5:
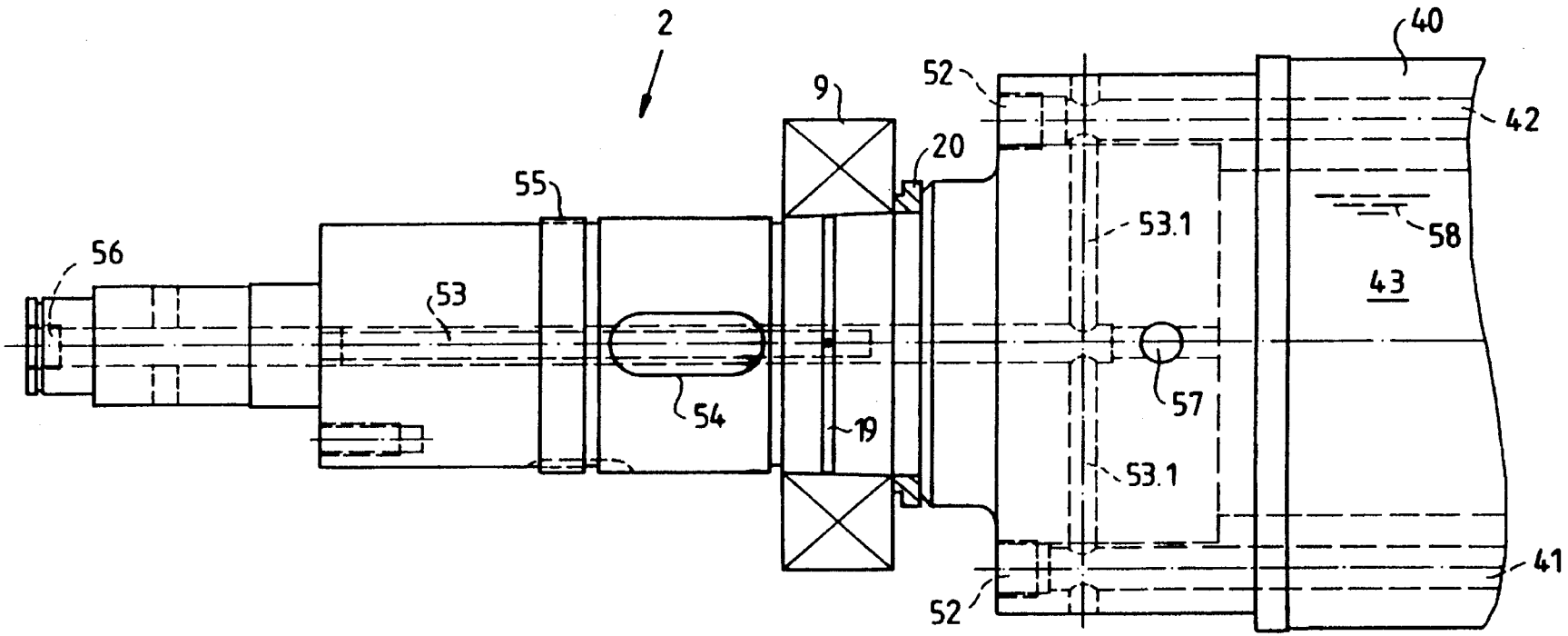
FIG. 5 is an enlarged view of the gear side of an alternative embodiment of a printing unit cylinder.

As can be seen from FIG. 5, which represents an enlarged view of a printing unit cylinder body 40 (gear side end) according to an alternative embodiment of the present invention, the gas conducted within the gas passages 41, 42 is fed by a pipe system, including a gas inlet 56, a gas passage 53 and a branch 53.1. As further can be seen in FIG. 5, the at least one compartment 43 has no contact at all with the gas feeding system 53, 53.1, 41, 42. On the gear side 2 there is provided a key 54 for a driving gear (not shown) and a corresponding threading 55 to allow fixing of the driving gear by means of a lock nut (see FIGS. 3, 4). By means of plugs 52, 57 the gas passages 41 and 42, respectively, are closed and sealed from the atmosphere.

FIGS. 4 and 5 show that the means (as outlined above) to expand a tubular sleeve are sealed hermetically from the means to reduce distortion of the cylinder during its rotation. The fluid 58 contained within the at least one compartment 43 allows for easing out temperature differences on the cylinder body's circumference. The gas pipe system supplying gas to blow off the sleeve is not affected, since gas can be distributed to the blow off grooves 15 on the cylinder's circumference by a separated pipe system. It is furthermore conceivable to supply the compartment 43 with an internal spiral jacket 110 for a circulating fluid as shown in FIGS. 4(*b*) and 4(*c*). The circulation of the fluid could be accomplished either by a circulation system 100 connected to the insertion opening 48 as shown in FIG. 4(*b*) or by means of a pump 101 being located inside the compartment 43 as shown in FIG. 4(*c*). In comparison, the means to blow off a cylindrical sleeve in the embodiment according to FIGS. 2 and 3 extend through the compartment 10, which contains the fluid 33, so there is a compressible seal 24 provided to separate the air passage 5 and the central bore 16 from the fluid 33. That, consequently, allows in this embodiment the parallel use of a fluid as a distortion reducing means and of gas as a means to expand a tubular sleeve.

While the present invention has been detailed in the embodiments described above, it is contemplated the invention may encompass further embodiments than those described. It is also contemplated that various gases, including air, could be used to blow off the cylinder sleeve. Various fluids, including water, could be used as the fluid to reduce distortion.

What is claimed is:

1. A printing unit cylinder having reduced susceptibility to thermal distortion, for use in a lithographic printing press, comprising:

a cylinder body having an outer surface and a central axis, a first width of the cylinder body for supporting a removable sleeve shaped element, the cylinder body including:

a gas passage extending generally parallel to the central axis of the cylinder body, the gas passage extending substantially across the first width;

a gas inlet disposed in the cylinder body and connecting the gas passage with the outer surface of the cylinder body;

an inner compartment isolated from the gas passage, the inner compartment having a second width substantially equal to the first width, the inner compartment containing a fluid and reducing thermal distortion by maintaining a substantially uniform and constant temperature level around the circumference of the cylinder;

a penetration disposed in the cylinder body and connecting the inner compartment with the outer surface of the cylinder body to permit the inner compartment to be charged with the fluid; and a blow off aperture disposed in the outer surface of the cylinder body and in fluid communication with the gas passage, for conducting gas to the outer surface of the cylinder body in order to facilitate the installation and removal of the sleeve-shaped element.

2. The printing unit cylinder as recited in claim 1, further comprising a seal disposed within the cylinder body and between the gas passage and the inner compartment for hermetically isolating the gas passage from the inner compartment.

3. The printing unit cylinder as recited in claim 1, further comprising a groove disposed in the outer surface of the cylinder body and coupled to the blow off aperture.

4. The printing unit cylinder as recited in claim 1, further comprising at least one baffle disposed in the inner compartment for subdividing the inner compartment.

5. The cylinder as recited in claim 1, further comprising means for circulating the fluid in the inner compartment.

6. The cylinder as recited in claim 1, wherein the gas passage is disposed coaxial with the central axis of the cylinder body.

7. A lithographic printing press for printing on material in sheet or web form, comprising:

a printing cylinder having a printing form removably mounted thereon;

a blanket cylinder having a gapless sleeve-shaped blanket removably mounted thereon, the blanket cylinder having a central axis and a blanket supporting surface, the blanket supporting surface having a first width, the blanket cylinder engageable with the printing cylinder and having at least one compartment, the at least one compartment having a second width substantially equal to the first width, the at least one compartment containing a fluid and reducing thermal cylinder distortion by maintaining a substantially uniform and constant temperature level around the circumference of the blanket cylinder;

an expansion mechanism disposed in the blanket cylinder for expanding the blanket to facilitate its installation and removal, the expansion mechanism extending generally parallel to the central axis of the blanket cylinder and substantially across the first width.

8. The printing press as recited in claim 7 wherein the printing form is a cylindrical printing form and the printing cylinder includes an expansion means for expanding the cylindrical printing form to facilitate its installation and removal.

9. The printing press as recited in claim 7 wherein the fluid is pressurized.

10. The printing press as recited in claim 7, further comprising means for circulating the fluid in the at least one compartment.

11. The printing press as recited in claim 7 further comprising an external circulation system and wherein the blanket cylinder includes a spiral internal jacket coupled to the external circulation system.

12. The printing press as recited in claim 7 wherein the blanket cylinder further includes a closed, internal spiral shell having an internally mounted circulation pump.

13. The printing press as recited in claim 7, further comprising a seal for sealing the expansion mechanism from the at least one compartment.

14. The printing press as recited in claim 7 wherein the blanket cylinder includes a central bore comprising a centrally extending gas passage.

15. The printing press as recited in claim 14 further comprising a compression member removably mounted on the gas passage.

16. The printing press as recited in claim 15, further comprising a seal mounted on the gas passage, the compression member applying a load to the seal.

17. The printing press as recited in claim 16, further comprising a center piece removably mounted in the central bore and defining an air chamber between the compression member and the center piece.

* * * * *